US005117995A

United States Patent [19]

Kau

[11] Patent Number: 5,117,995

[45] Date of Patent: Jun. 2, 1992

[54] STOPPER

[76] Inventor: Alexander Kau, Lindenstr. 29, D-5208 Eitorf, Fed. Rep. of Germany

[21] Appl. No.: 734,502

[22] Filed: Jul. 23, 1991

[30] Foreign Application Priority Data

Jan. 29, 1991 [DE] Fed. Rep. of Germany ..... 4102475

[51] Int. Cl.[5] ..... B65D 39/12; B65D 51/26; A63H 37/00; F41B 7/00

[52] U.S. Cl. ..... 215/228; 215/227; 215/364; 116/281; 222/563; 446/475; 124/26; 124/83; 220/212; 220/522; 220/254

[58] Field of Search ..... 215/228, 227, 230, 355, 215/358, 364; 220/254, 521, 522, 212; 116/281; 222/563, 129; 40/311, 332; 446/475; 124/26, 83, 79

[56] References Cited

U.S. PATENT DOCUMENTS

| | | | |
|---|---|---|---|
| 692,359 | 2/1902 | Rouse | 215/358 X |
| 815,172 | 3/1906 | Huffman | 215/358 |
| 1,560,326 | 11/1925 | Rutherford | 446/475 |
| 1,663,679 | 3/1928 | Carpenter | 446/475 X |
| 2,954,890 | 10/1960 | Del Valle | 215/270 |
| 3,009,594 | 11/1961 | Anson | 215/228 |
| 3,135,410 | 6/1964 | Federighi | 215/227 |
| 3,224,141 | 12/1965 | Borak | 124/26 X |
| 3,433,378 | 3/1969 | Ross | 215/228 X |
| 3,780,897 | 12/1973 | Wassilieff | 215/253 |
| 4,033,091 | 7/1977 | Saponara | 215/228 X |
| 4,509,655 | 4/1985 | Killmann | 215/309 |
| 4,691,836 | 9/1987 | Wassilieff | 215/298 |
| 4,717,032 | 1/1988 | Wu | 215/228 |
| 4,787,160 | 11/1988 | Balsamo | 446/475 X |
| 4,836,821 | 6/1989 | Raymond | 446/330 |
| 5,033,446 | 7/1991 | Bradt | 124/26 |

FOREIGN PATENT DOCUMENTS

| | | | |
|---|---|---|---|
| 454674 | 3/1927 | Fed. Rep. of Germany | 446/475 |

*Primary Examiner*—Stephen Marcus
*Assistant Examiner*—Vanessa Caretto
*Attorney, Agent, or Firm*—Edwin D. Schindler

[57] ABSTRACT

A stopper for stoppering a bottle having a bottleneck and containing a beverage pressurized by carbon dioxide. The stopper includes a hollow body, preferably made of plastic, having a top opening which is able to be closed by a cover, the hollow body having a shank. A compressed elastic, for example, a spring, is being positioned in the hollow body. A charge carrier is arranged on an end of the compressed elastic and is directed toward the opening of the hollow body. The charge carrier is locked into position on the end of the elastic and is retained in a compressed state for as long as the shank of the hollow body is in the bottleneck of the bottle and is hindered by the bottleneck from giving way outwardly.

13 Claims, 3 Drawing Sheets

STOPPER

The invention relates to a stopper for stoppering bottles containing beverages pressurized by carbon dioxide, especially champagne and the like. The stopper includes a hollow plastics body which is open at the top the opening of which can be closed by a cover.

It is known how to stopper champagne bottles with hollow plastic stopper which are often filled by a core of natural cork for stabilization. The opening of the hollow stopper is closed by a cover which is often used for the impression of firm names or trade names.

It is well known that the opening of a bottle of champagne is a social occasion promoting the spirits of the involved persons.

It is an object of the present invention to provide a stopper for corking bottles containing beverages pressurized by carbon dioxide, especially champagne, fizz, sparkling wine and the like by which the mood of the persons who are present is livened up when the bottle is opened.

It is a further object of the invention to provide a champagne stopper made of plastics by which the persons present in an elated mood when opening the champagne bottle, are appealed to by advertisements.

A further object of this invention is to provide a champgane stopper which causes a mood promoting effect or a publicity event in the moment of uncorking. Further advantages will become apparent from the following specification.

According to the present invention these aims are achieved with the above-mentioned stopper in that a compressed elastic means is placed in the interior of a hollow body. A charge carrier is arranged on the end of said compressed elastic means directed to the opening of the hollow body and the charge carrier is held in its position. Consequently, the elastic means is kept compressed as long as the shank of said hollow body is in the bottleneck and is hindered by the latter from giving way outwardly. The hollow space of the stopper consequently contains an elastic means which is kept in a compressed or tensioned state as long as the shank of the stopper is in the bottleneck and the hollow space of the shank is constricted by the acting radial forces. The charge carrier on said elastic means is locked by this constriction and said elastic means is kept pressurized with it. When the stopper is removed from the bottleneck, the radial forces slacken immediately, the locking of the charge carrier is neutralized, and said elastic means impels the charge carrier into the direction towards the opening of the hollow space whereby materials in the hollow space above said charge carrier are expelled out of the stopper. The charge material expelled from the stopper may be e.g., confetti, glitter material, a paper streamer which is unfolded when flying out, or promotion matter for a special product.

According to a preferred embodiment of the invention said elastic means is a compression coil spring. Sufficient energy can be stored in this spring to throw out the charge material sufficiently far and high, which is beneficial for attaining the desired effects.

Preferably the charge carrier is caught in the hollow space of the shank. Usually the over-all dimension of the stopper shank is larger than the inside width of the bottleneck at its narrowest point so that the hollow body shank is constricted when the stopper is driven into the bottleneck. Preferably, the diametral dimension of the charge carrier is selected so that the charge carrier, which comprises a rigid material (e.g., metal) is clamped by the constriction of the inside width of the hollow space which occurs anyway, whereby said elastic means is kept in its compressed state.

According to another embodiment of the invention the charge carrier is kept in its position by at least one projection formed inside of the stopper shank. The projection may be an annular bulb or a plurality of nubs. The shank wall can yield outwardly when the preferably plate-shaped charge carrier is forced into the hollow space of the stopper, which is being outside of the bottleneck so that the charge carrier can pass the projection(s). When the stopper, with the charge carrier held in this position, has been forced into the bottleneck, the shank wall can no longer yield outwardly so that even under the pressure of the compressed elastic means the charge carrier can no longer pass the projections and the tension of said elastic means is kept until unstoppering.

According to a further embodiment of the invention at least two outwardly projecting latches are formed in the shank wall, which are turned inwards by the bottleneck wall with stoppering, and then hold the charge carrier in its position against the force exerted by said elastic means. As the forming of these latches requires piercing of the shank wall at the respective places, the sealing of this stopper must be assured below said latches. The latches may be formed in that without piercing the shank wall, projections formed on the outside of the shank, e.g. nubs, are forced inwardly by the bottleneck wall during stoppering and form projections there which the charge carrier can no longer pass. The charge space between the charge carrier and the cover can be filled by a charge which can correspond, in a variable manner, to the desired effects and purposes. Other effects can be achieved with materials other than confetti, glitter materials, paper streamers or promotion matter for a special product. For instance a torpedo can be inserted between the plate-shaped carrier and the cover which cracks by the push of the carrier. A foil ampule containing perfume or toilet water can be inserted which is squashed between the carrier and the cover so that a cloud of perfume is developed. Finally, individual charges, e.g. engagement rings, can be put into the charge compartment.

According to the preferred embodiment of the invention, the closing force of the cover inserted into the hollow space opening is smaller than the motive power transmitted from the released elastic means to the cover. Generally, the motive power is substantially higher than the closing force so that the cover is thrown out together with the charge by means of the blow of the charge carrier. If the cover is mounted in the opening by means of a shallow annular groove and an annular tongue, the closing force can be increased or reduced depending on the form of annular groove and tongue so that the cover will be discarded more or less easily.

According to a further embodiment of the stopper, the lumen of said hollow space adjacent to the opening is reduced by projections, an annular bulb or the like to a dimension smaller than the diameter of the charge carrier, or the charge carrier is fixed to the end of said elastic means facing toward the opening; the other end of the elastic means being fastened to the hollow plastics means. By these projections or this fixing of the carrier and the elastic means to the hollow plastics body, assurance is provided that the carrier and the elastic means are retained in the stopper when the charge is expelled. In this way these parts are prevented from flying out of the stopper and possibly insuring persons present at the occasion. A natural cork body can be, for instance, firmly inserted, e.g., glued into the lower part of the hollow plastics body. The elastic means with the plate-shaped charge carrier can be fixed to this natural cork body.

The method for stoppering a champagne bottle or the like according to the present invention is characterized in that the charge carrier in the stopper is forced into a lower position with compression of said elastic means, then after having increased the pressure, the stopper is pressed into the bottleneck thereby fixing the position of the charge carrier in the hollow space of the stopper. Thereafter, if desired, the charge compartment above the charge carrier, is filled and closed. When stoppering the bottle, the stopper according to the invention can be generally driven into the bottleneck in the same manner as the plastics stoppers known up to now. Owing to the action of the driving-in stamp onto the charge carrier during stoppering, the elastic means is compressed in any case.

The invention is specified herebelow with reference to the accompanied drawings.

Figure 1:
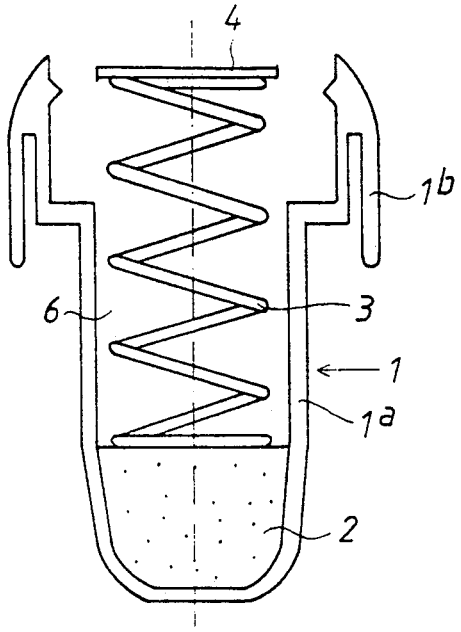
FIG. 1 shows an axial cross sectional view of a first embodiment of a champagne stopper outside of the bottleneck.

According to FIG. 1, the hollow stopper includes a shank $1^a$ and a head $1^b$ having a diameter substantially increased with respect to the shank. The shank $1^a$ has an upper cylindrical portion and a truncated cone-shaped portion downwardly joined to the cylindrical portion. The upper cylindrical portion can be externally corrugated (not shown). The interior of the lower truncated cone-shaped portion of the shank $1^a$ is filled by a body 2 of natural cork. A coil spring 3 is fastened to the natural cork body 2 and at its upper end fixed to a plate 4.

Figure 2:
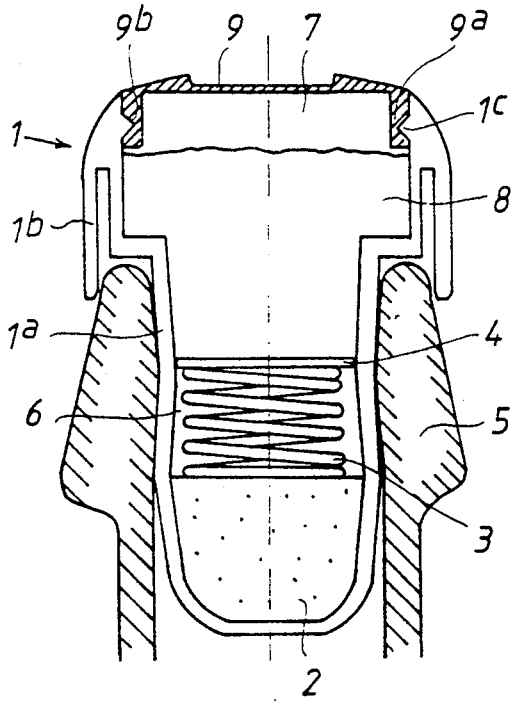
FIG. 2 shows the champagne stopper of FIG. 1 after having driven it into the bottleneck and filled and closed the charge compartment.

FIG. 2 shows the mouth 5 of a champagne bottle which, on the inside, is first somewhat narrowed from the upper end in the downward direction and then is slightly broadened again. A pressure stamp (not shown) acting on the plate 4 serves for driving the stopper shown in FIG. 1 into the bottle mouth 5. By this initial procedure, the coil spring 3 is compressed and assumes the shape shown in FIG. 2. Then the stopper 1 is driven into the mouth with the same stamp whereby the clear space 6, within the cylindrical portion of the shank $1^a$, is somewhat narrowed By this the wall of the shank la comes into engagement with the edge of the plate 4 whereby the plate 4 is arrested in the position shown in FIG. 2. With this the spring 3 remains permanently tensioned. Subsequently, or at a later time, the charge compartment 7 can be filled with the charge 8, e.g., confetti. Then the compartment 7 is closed by a cover 9. For this the stopper head $1^b$ has inside an annular bulb $1^c$, and the cover 9 has a collar $9^a$ projecting into the compartment 7 and on said collar $9^a$ an annular groove $9^b$ adapted to interact with said bulb $1^c$. The retaining force of the cover 9 in the opening assures that the cover on the one hand, does not inadvertently open and release the charge, but on the other hand is pushed off when the spring 3 is released.

Figure 3:
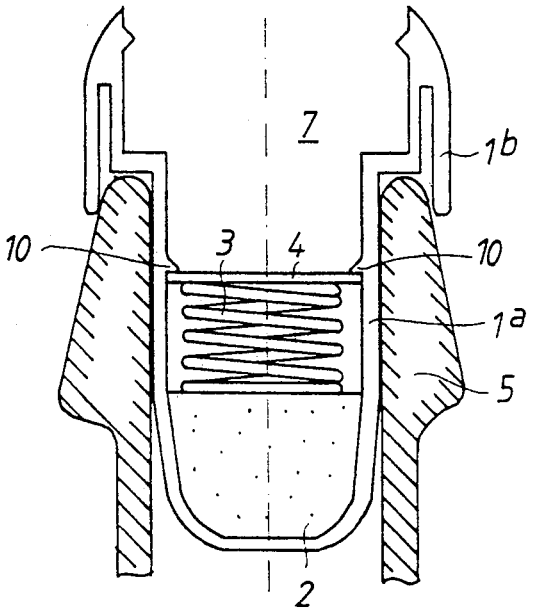
FIG. 3 shows an axial cross sectional view of a second embodiment of the champagne stopper after having driven it into the bottleneck, but before charging and closing the charge compartment.

While with the embodiment of FIG. 2 the plate 4 is only kept by the wall of the shank $1^a$ by means of radial clamping forces, according to the embodiment of FIG. 3 several nubs 10 are circumferentially distributed on the inside of the shank $1^a$, the top side of said nubs being beveled and their bottom side being arranged perpendicularly to the stopper axis. When the plate 4 is forced into the stopper and the spring 3 is compressed, the plate 4 slips over the nubs 10 whereby the wall of the shank $1^a$ yields outwardly because the stopper is outside of the bottle mouth. After having brought the plate 4 and the spring 3 in this way into the position shown in FIG. 3, the stopper is driven into the mouth 5 of the bottle. By the force of the spring the plate 4 lies against the bottom side of the nubs 10 which now can no longer yield outwardly and hold the plate 4 in the shown position until the stopper is again removed out of the bottle mouth.

Figure 4:
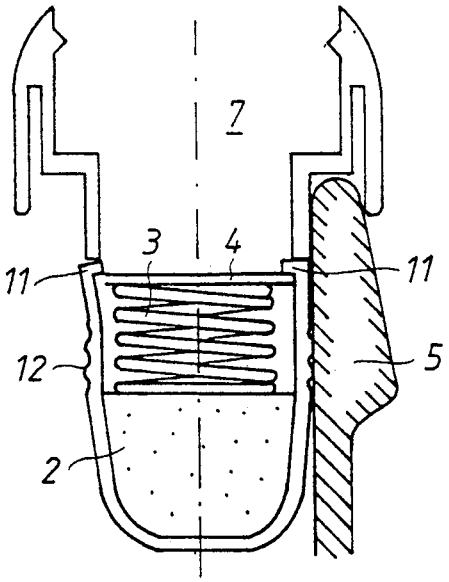
FIG. 4 shows an axial cross sectional view of a third embodiment of the champagne stopper with its left side before driving it into the bottleneck and its right side after driving it into the bottleneck.

The embodiment according to FIG. 4 differs from the embodiment of FIG. 3 in that, instead of nubs 10 movable latches 11 are provided which normally take the position shown on the left side of FIG. 4. In this position they project somewhat outwardly so that they cannot detain the setting of plate 4 into the position shown in FIG. 4. When the stopper is driven into the bottleneck the internal face of the bottle mouth 5 pushes the latches 11 inwards into a position in which they lap over the plate 4 and which is shown on the right side of FIG. 4. Then the plate 4 and the spring 3 are locked in the position shown in FIG. 4 as long as the stopper is in the bottleneck because the latches 11 cannot yield outwards. With unstoppering, however, the latches release the plate 4 so that the charge on the plate is thrown out. The outside of the stopper is provided with corrugations 12 in its cylindrical portion below the latches in order to achieve a safe sealing between the stopper and the inside of the bottle mouth 5.

Figure 5:
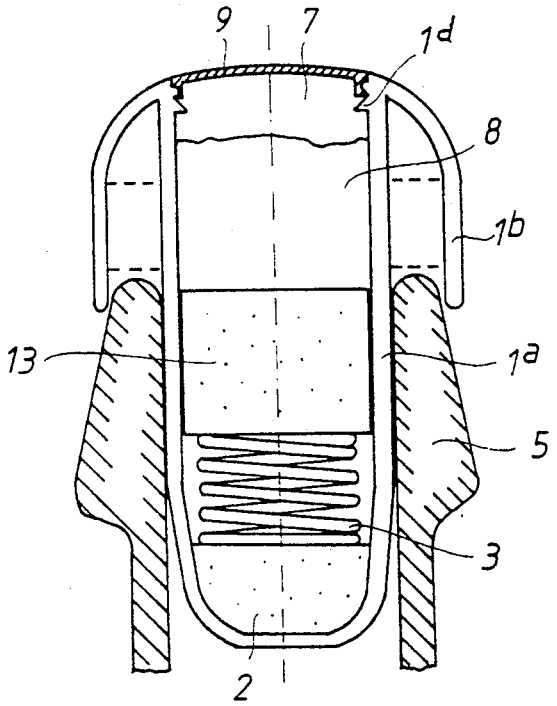
FIG. 5 shows an axial cross sectional view of a fourth embodiment of the champagne stopper of the invention.

To achieve a good sealing it is useful, with these hollow plastics stoppers to stabilize the cylindrical shank portion against the forces directed radially inwards from the bottle mouth. With the above-specified embodiments the plate 4 has this function, to a certain degree, by preventing the shank wall from yielding inwards and consequently the sealing from being impaired. But with these embodiments the stabilization extends only over the small range of the plate thickness. With the embodiment of FIG. 5 the plate 4 is replaced by a cylindrical natural cork body 13 which is only fixed in the cylindrical portion of the shank $1^a$ by radial clamping forces in the same manner as with the embodiment of FIG. 2. Unlike the plate 4, the body 13 stabilizes the wall of the shank $1^a$ over a longer axial zone which is favorable for the sealing properties. Consequently, with this embodiment the spring 3 is arranged between both natural cork bodies 2 and 13.

Projections $1^d$ are provided on the inside near to the mouth of the hollow stopper. They serve as stop for the cork body 13 during unstoppering and prevent its springing out, but do not prevent the ejection of the charge 8. The ejection of the body 13 and the plate 4, respectively, can also be avoided by fastening the bodies 13 or 4 to the spring 3 which is firmly connected with the natural cork body 2 fixed in the truncated cone-shaped portion of the shank $1^a$, for instance by means of an adhesive.

I claim:

1. A stopper for stoppering a bottle, having a bottleneck, containing a beverage pressurized by carbon dioxide, said stopper comprising:

a hollow body having a top opening which is able to be closed by a cover, said hollow body having a shank;

compressed elastic means being positioned in said hollow body;

a charge carrier is arrange don an end of said compressed elastic means and is directed toward the opening of said hollow body;

locking means for retaining said charge carrier in position on the end of said elastic means and means for locking said elastic means in a compressed state for as long as said shank of said hollow body is in the bottleneck of the bottle and is hindered by the bottleneck from giving way outwardly.

2. The stopper according to claim 1, wherein said hollow body is made of a plastic material.

3. The stopper according to claim 1, wherein said elastic means is a compression coil spring.

4. The stopper according to claim 1, wherein said charge carrier is caught in a hollow space of said shank.

5. The stopper according to claim 1, wherein said charge carrier is kept in position by at least one projection formed inside of said shank.

6. The stopper according to claim 1, further comprising at least two outwardly projecting latches being formed in a wall of said shank, said latches being formed in a wall of said shank, said latches being turned inwardly by the bottleneck wall with stoppering and holding said charge carrier in position against a force being exerted by said elastic means.

7. The stopper according to claim 1, further comprising a cover for said hollow body with a charge space being provided between said cover and said charge carrier which is able to be filled by a charge.

8. The stopper according to claim 7, wherein a closing force for said cover is smaller than a motive power transmitted from the release of said elastic means to said cover.

9. The stopper according to claim 7, wherein a lumen of the charge space adjacent to the opening is reduced by projections to a dimension which is smaller than the diameter of said charge carrier.

10. The stopper according to claim 9, wherein said projections are nubs.

11. The stopper according to claim 9, wherein said projections include at least one annular bulb.

12. The stopper according to claim 1, wherein said carrier charge is fixed to a first end of said elastic means which faces toward the opening of said hollow body with a second end of said elastic means being fastened to said hollow body.

13. A bottle, having a bottleneck, containing a beverage pressurized by carbon dioxide, comprising:

a stopper, said stopper including:

a hollow body having a top opening which is able to be closed by a cover, said hollow body having a shank;

compressed elastic means being positioned in said hollow body;

a charge carrier is arranged on an end of said compressed elastic means and is directed toward the opening of said hollow body;

locking means for retaining said charge carrier in position on the end of said elastic means and means for locking said elastic means in a compressed state for as long as said shank of said hollow body is in the bottleneck of the bottle and is hindered by the bottleneck from giving way outwardly.

* * * * *